US006454222B1

(12) United States Patent
Steelman

(10) Patent No.: US 6,454,222 B1
(45) Date of Patent: Sep. 24, 2002

(54) EASY RAKE TRASH BAG HOLDER

(75) Inventor: Thelma Jean Steelman, 5800 Defiance Ave., Orlando, FL (US) 32839-4002

(73) Assignee: Thelma Jean Steelman, Orlando, FL (US)

( * ) Notice: Subject to any disclaimer, the term of this patent is extended or adjusted under 35 U.S.C. 154(b) by 0 days.

(21) Appl. No.: 09/636,292

(22) Filed: Aug. 10, 2000

Related U.S. Application Data

(60) Provisional application No. 60/148,114, filed on Aug. 10, 1999.

(51) Int. Cl.[7] ..... B65B 67/00
(52) U.S. Cl. ..... 248/99; 248/101
(58) Field of Search ..... 248/97–101; 294/55

(56) References Cited

U.S. PATENT DOCUMENTS

| | | | | | |
|---|---|---|---|---|---|
| 3,733,099 | A | * | 5/1973 | Szita | 294/55 |
| 3,788,720 | A | * | 1/1974 | Schneider | 248/99 |
| 4,664,348 | A | * | 5/1987 | Corsaut | 248/99 |
| 4,738,478 | A | * | 4/1988 | Bean | 294/55 |
| 5,065,891 | A | * | 11/1991 | Casey | 248/99 |
| 5,139,219 | A | * | 8/1992 | Navarro | 248/97 |
| 5,209,442 | A | * | 5/1993 | Buck | 248/99 |
| D445,550 | S | * | 7/2001 | Wigren | D34/6 |

* cited by examiner

*Primary Examiner*—Alvin Chin-Shue

(57) ABSTRACT

A bag holder for holding a disposable plastic bag in an open position for filling with refuse and debris. The bag holder comprises a flexible strap member with snap fit fasteners for securing the opening of the disposable plastic bag to the flexible strap member.

6 Claims, 2 Drawing Sheets

EASY RAKE TRASH BAG HOLDER

This application claims benefit to provisional application 60/148,114 filed Aug. 10, 1999.

FIELD OF THE INVENTION

This invention relates to a device for holding the common disposable plastic trash bag in an open position for filling with refuse and debris. More particularly, the invention is directed to a molded one-piece holder that is ready to use with one hand to facilitate filling trash bags for disposing of garden, lawn, industrial, and commercial waste materials.

BACKGROUND OF THE INVENTION

Many trash bag holders are disclosed in the prior art for performing the function of maintaining a trash bag in an open position to enable the user to easily rake leaves into it for disposal. Few of the patented devices are commercially available, however. For many are expensive to produce and difficult to handle because of size or operation. U.S. Pat. Nos. 4,702,445; 5,180,126; 5,413,394; 5,913,496; 6,076,782; 6,076,783; and 6,012,687 exemplify such known devices.

U.S. Pat. No. 5,014,943 discloses a hoop that fits into the mouth of a plastic trash bag and includes a mechanism for adjusting the size of the hoop to peripherally expand from a collapsed form to fit tightly against the inner surface of the bag edge portion. Unlike the instant invention, this known device depends entirely on frictional contact between the outer surface of the tightened hoop and the inside surface of the trash bag for it to operate. A pan is integrally molded to the hoop with a living hinge to pivotally move between an open and closed condition. This device can be stored in a "blank" form as one flat integral unit.

U.S. Pat. No. 5,718,400 discloses a trash bag holder with a handle and a sweeping ramp to facilitate the raking of trash, leaves, and other debris into an open trash bag that is mounted to a rigid rectangular frame structure. Four (4) clamp elements on two sides of the rectangular structure hold the edge portion of the trash bag passed upwardly through the inside of the frame. So, in use, the outer surface of the bag is in contact with the inside of the frame structure. This, of course, would interfere with the efficient operation of the sweeping ramp when the known device is used in a manner other than hanging on the wall as shown in its FIG. 6.

U.S. Pat. No. 5,735,496 discloses a device for holding a flexible bag inside a receptacle using U-shaped resilient clips disposed over the top edge of a trash receptacle. The clips are not used in conjunction with a device for raking debris into the open mouth of a plastic trash bag.

PURPOSE OF THE INVENTION

The primary purpose of the invention is to provide an inexpensive device that anyone can easily use to facilitate sweeping trash, leaves, and debris into an open trash bag.

Another object of the invention is to provide a flexible strap member with integrally formed fastening means that can easily manipulated by the user.

Other objects, features, and advantages will become evident based on the following description of the embodiments shown in the accompanying drawings.

SUMMARY OF THE INVENTION

The invention is directed to a trash bag holder for stabilizing an opening edge portion of a flexible bag in an open condition to receive refuse. The holder comprises a flexible strap member including two free opposing ends and coupling means for releasably connecting the two ends to form a closed supporting ring. The strap member has a length sufficient for the supporting ring to adjustably fit to the opening edge portion of the flexible bag opening and a width sufficient to facilitate the sweeping of refuse into the open bag.

Gripping means is disposed along the length of the strap member and has an open and closed position for releasably clamping the opening edge portion to the closed substantially rigid supporting ring for retaining the bag opening edge portion when the gripping means is in a closed clamping position. This strap member includes an inner and outer surface across said width, an inner edge along said strap length to be directed inwardly with respect to the flexible bag, and an outer edge along said strap length to be directed outwardly with respect to the bag. A ramp portion is rigidly connected to the outer edge of the strap member at a location intermediate the two opposing end portions to further enhance the sweeping of refuse into the open bag. The outer surface of the strap width is effective to fit contiguously to an inside surface of the bag opening edge portion.

The gripping means includes pivotally mounted fastening means which is effective to fixedly clamp the bag opening edge portion in place with respect to the outer width surface when the closed supporting ring is disposed within the bag opening edge portion. The fastening means includes flap means and first and second frictionally engaging means for releasably retaining the bag opening edge portion. The flap means is pivotally mounted to an outwardly directed edge or outer width surface of said strap member and has an inner, bag retaining surface that faces the outer width surface of the strap member when the gripping means is in a closed clamping position. One of said first and second frictionally engaging means is disposed on said inner, bag retaining surface of said flap means.

In a specific embodiment, the flap means includes a plurality of flap members laterally displaced with respect to each other along the length of the strap member to provide a substantially uniform clamping effect along the bag opening edge portion which is contiguously disposed against the outer width surface of the strap member. Each flap member includes a frictionally engaging projection member disposed on said inner, bag retaining surface for frictionally engaging a projection member receiving means disposed along the outer width surface of the strap member.

The projection member receiving means includes undercut groove means located on the outer width surface of the strap member to receive the frictionally engaging projection member of each flap member. The undercut groove means is a groove having a lip portion that extends along the length of the strap member.

Each flap member includes a free end section which carries said projection member that frictionally fits into the groove of the strap member to frictionally engage the lip portion when the flap member is manually forced into a closed clamping position after the outer width surface of the strap member is disposed within the bag opening edge portion to retain the edge portion of the bag opening between the free end section of the flap member and the outer width surface of the strap member.

In another embodiment, the fastening means includes flap means and frictionally engaging means for releasably retaining the bag opening edge portion. The flap means is pivotally mounted to an outwardly directed edge or outer width surface of said strap member. The flap means having an inner, bag retaining surface that faces the outer width surface of the strap member when the gripping means is in a closed clamping position. The frictionally engaging means is disposed on said inner, bag retaining surface of said flap means which includes a plurality of flap members laterally displaced with respect to each other along the length of the strap member to provide a substantially uniform clamping effect along a periphery of the bag opening edge portion which is contiguously disposed against the outer width surface of the strap member. Each flap member includes a free end section and a frictionally engaging projection member disposed at the free end section on the inner, bag retaining surface for frictionally engaging the inner edge of the strap member. Each flap member has a length sufficient to extend across the outer width surface of the strap member. The free end section includes an inner strap edge engaging member that frictionally snaps over said inner edge of the strap member when the flap member is manually forced into a closed clamping position after the outer width surface of the strap member is disposed within the bag opening edge portion and between the free end section of the flap member and the inner strap edge.

More specifically, the strap member of the invention includes an inner and outer surface across its width, an inner edge along the strap length that is directed inwardly with respect to the flexible bag, an outer edge along the strap length is directed outwardly with respect to the bag, and handle means is located on the strap outer surface to be manually gripped by a user of the trash bag holder. The outer surface of the strap width is effective to fit contiguously to an inside surface of the bag opening edge portion. The gripping means includes pivotally mounted fastening means which is effective to fixedly clamp the bag opening edge portion in place with respect to the outer width surface when the closed supporting ring is disposed within the bag opening edge portion. The handle means is disposed at a location on the outer strap surface and is located at the top of the ring once the opposing ends of the strap member are releasably connected to each other. A ramp portion is rigidly connected to the outer edge at a location intermediate the two opposing end portions to further enhance the sweeping of refuse into the open bag.

In a molded product of the invention, each flap member, ramp portion, knob elements, and handle member are integrally formed as a unitary structure with the strap member. A living hinge is effective to enable each flap member to pivotally rotate with respect to the strap member. The coupling means for releasably connecting the two ends of the strap member includes a plurality of knob elements at one of the opposing strap ends and a plurality of knob receiving holes at the other opposing end effective to releasably snap engage said knob elements. The knob elements are directed outwardly from the outer surface of the strap member and integrally formed as a unitary structure with said strap member along a line parallel to the outer edges of the strap member. The knob receiving holes are disposed along said same line that is parallel to the outer edges of the strap member so that the knob elements mesh with the knob receiving holes when the opposing ends of the strap member overlap to form the closed supporting ring.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figures 1, 2:
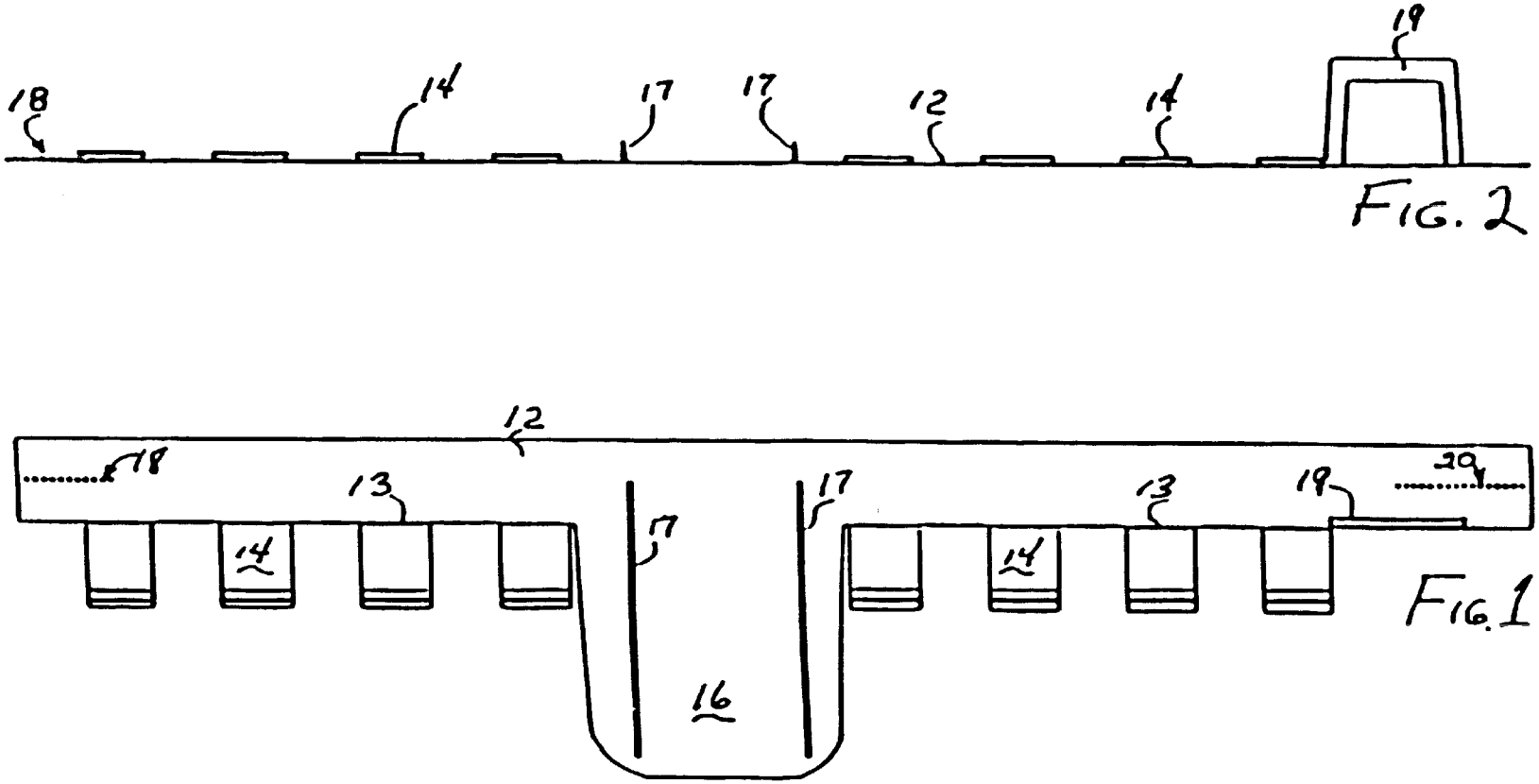
FIG. 1 is a top plan view of the outer surface of the flexible holding device according to this invention.
FIG. 2 is a front elevational view of the device of FIG. 1.
Figure 3:
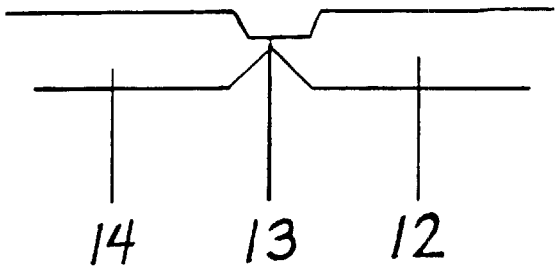
FIG. 3 is a diagrammatic sectional view of the living hinge connection between a flap member at the edge of the molded strap member.

Trash bag holder 10 includes a body portion strap member 12 that includes integrally formed flap members 14 distributed equally along an outer edge of strap member 12. Sweeping ramp 16 includes bottom stabilizers 17 and is integrally molded to strap member 12 for a fixed connection at a location on its outer edge between flap members 14 as shown. Handle member 19 is integrally molded to the outer surface of strap member 12 so that it is located at the top of the closed supporting ring when the two opposing ends are coupled together.

The coupling mechanism for releasably connecting the two opposing ends of strap member 12 in this embodiment includes a plurality of knob elements 18 projecting outwardly from the outer surface of strap member 12 and a plurality of knob receiving holes 20 at respective opposing ends. When the opposing ends are flexibly bent together to overlap, knob elements 18 snap engage holes 20 to form a closed supporting ring of the flexible strap member 12 to fit into the outer edge portion of the trash bag opening. A plurality of elements 18 provide more stability in the connection of the opposing ends than does a single element. In a specific embodiment, seven (7) plastic knob elements 18 fit into at least 10 openings at the other opposing end to allow some adjustability with respect to the bag opening. Because of the fastening mechanism design, the amount of frictional contact between the outer surface of strap member 12 and the inside surface of the bag opening edge portion is not critical as in other known devices of this type.

Figure 4:
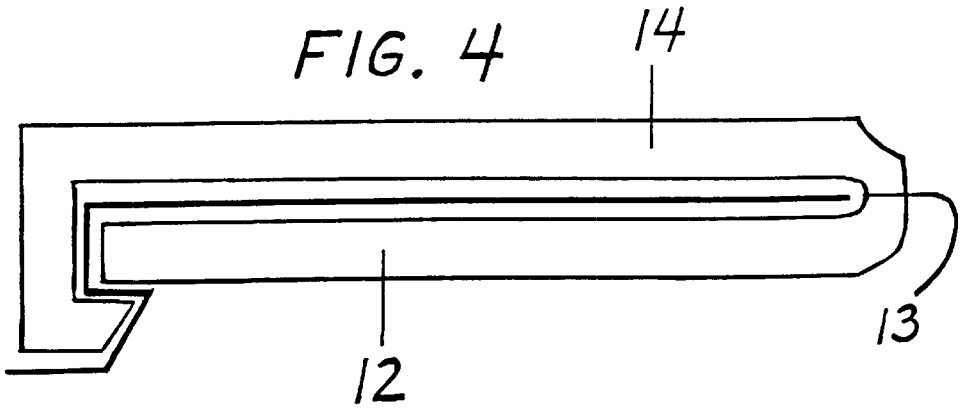
FIG. 4 is a cross-sectional view of an embodiment of a flap member according to this invention.

When the coupling mechanism connects the overlapping opposing ends, the inside of the bag opening edge portion is contiguously disposed against the outer surface of strap member 12. Flap members 14 are then pivotally bent at hinge 13 over the bag opening edge portion and outer surface of member 12 to a closed clamping position. FIG. 4 shows the flap member with a length sufficient to cross the outer width surface of body member 12 and the resilient hook configuration snaps over the inner edge of member 12 to hold the bag opening edge portion therebetween as shown. FIG. 5 depicts another embodiment wherein a groove 24 with an undercut lip portion 26 frictionally receives projection member 25 located on the outer end section 27 of the flap member 14*a* as shown. Again this embodiment clamps the bag opening edge portion to strap member 12, which includes a continuous groove 24 extending along the length and parallel to the inner edge of body portion 12. Projection members 25 thus snap engage groove 24 at any location so that knob elements 18 of the coupling mechanism may connect the two opposing ends at different locations in holes 20.

In this specific embodiment, body portion strap member 12 is fourteen (14) inches wide and sixty-six (66) inches long. Flap members 14 are three (3) inches wide and four (4) inches long to extend across the outer surface of member 12. Flap members 14 are laterally spaced three (3) inches with respect to each other, handle member 19 is four (4) inches long, and sweeping ramp is twelve (12) inches wide along the outer edge and extends outwardly twelve (12) inches from the outer edge as shown.

Strap member 12 is molded of a rubberized and/or plastic material to give it flexibility and at the same time provides sufficient rigidity to form a ring or hoop member that is placed inside the mouth opening of a trash bag. In so doing, the outer surface of strap member 12 is contiguously disposed against the inside of the edge portion of the plastic trash bag with which it is being used.

While the EASY RAKE TRASH BAG HOLDER has been shown and described in detail, it is obvious that this invention is not to be considered as limited to the exact form disclosed, and that changes in detail and construction may be made therein within the scope of the invention without departing from the spirit thereof Having thus set forth and disclosed the nature of this invention, what is claimed is:

1. A trash bag holder for stabilizing an opening edge portion of a flexible bag in an open condition to receive refuse, said holder comprising:

a) a flexible strap member including two free opposing ends and coupling means for releasably connecting the two ends to form a closed supporting ring, b) said strap member having a length sufficient for the supporting ring to adjustably fit to the opening edge portion of the flexible bag opening and a width sufficient to facilitate the sweeping of refuse into the open bag, and c) gripping means disposed along the length of the strap member and having an open and closed position for releasably clamping the opening edge portion to the closed supporting ring for retaining the bag opening edge portion when the gripping means is in a closed clamping position, wherein said strap member includes an inner and outer surface across said width, an inner edge along said strap length to be directed outwardly with respect to the bag, the outer surface of the strap width is effective to fit contiguously to an inside surface of the bag opening edge portion, and said gripping means includes a plurality of flap members laterally displaced with respect to each other along the length of the strap member for releasably retaining the bag opening edge portion, said flap members being pivotally mounted to an outwardly directed edge of said strap member, said flap members having an inner, bag retaining surface that faces the outer surface of the strap member when the gripping means is in a closed clamping position, each said flap member includes a free end section and a frictionally engaging projection disposed at said free end section on said inner, bag retaining surface for frictionally engaging said inner edge of the strap member, each said strap member has a length sufficient to extend across the outer width surface of the strap member, and said frictionally engaging member includes an inner strap edge engaging member that frictionally snaps over said inner edge of the strap member when the lap member is manually forced into a closed clamping position after the outer width surfaces of the strap member is disposed within the bag opening edge portion and between the free end section of the flap member and the inner strap edge.

2. A trash bag holder as defined in claim 1 wherein said strap member includes an inner and outer surface across said width, an inner edge along said strap length to be directed inwardly with respect to the flexible bag, and an outer edge along said strap length to be directed outwardly with respect to the bag, said strap member includes a ramp portion rigidly connected to the outer edge at a location intermediate the two opposing end portions to further enhance the sweeping of refuse into the open bag.

3. A trash bag holder as defined in claim 1 wherein each said flap member is integrally formed as a unitary structure with said strap member with a living hinge being effective to enable the flap member to pivotally rotate with respect to the strap member.

4. A trash bag holder as defined in claim 2 wherein said strap member includes a handle member integrally formed as a unitary structure with said strap member.

5. A trash bag holder as defined in claim 2 wherein said ramp portion is integrally formed as a unitary structure with said strap member.

6. A trash bag holder as defined in claim 1 wherein said coupling means for releasably connecting the two ends of the strap member includes a plurality of knob elements at one of the opposing strap ends and a plurality of knob receiving holes at the other opposing end effective to releasably snap engage said knob elements, said knob elements being directed outwardly from the outer surface of the strap member and integrally formed as a unitary structure with said strap member along a line parallel to the outer edges of the strap member, said knob receiving holes being disposed along said same line that is parallel to the outer edges of the strap member so that the knob elements mesh with the knob receiving holes when the opposing ends of the strap member overlap to form the closed supporting ring.

* * * * *